United States Patent [19]

Norström et al.

[11] Patent Number: 4,459,162

[45] Date of Patent: Jul. 10, 1984

[54] HOT WORK STEEL

[76] Inventors: Lars-Åke Norström, Villavägen 6; Nils A. Öhrberg, PL 5264, Bergsäng, both of S-683 00 Hagfors, Sweden

[21] Appl. No.: 411,831

[22] Filed: Aug. 26, 1982

Related U.S. Application Data

[63] Continuation of Ser. No. 185,942, Sep. 10, 1980, abandoned.

[30] Foreign Application Priority Data

Dec. 3, 1979 [SE] Sweden ..... 7909935

[51] Int. Cl.[3] ..... C22C 38/08; C22C 38/12; C22C 38/22; C22C 38/32

[52] U.S. Cl. ..... 148/36

[58] Field of Search ..... 75/126 A, 126 B, 126 E, 75/126 H, 126 P, 128 A, 128 B, 128 F, 128 V, 128 W; 146/36

[56] References Cited

U.S. PATENT DOCUMENTS

| | | | |
|---|---|---|---|
| 1,496,980 | 6/1924 | Armstrong | 75/126 C |
| 2,686,115 | 8/1954 | Clark | 148/36 |
| 3,128,175 | 4/1964 | Nagy et al. | 148/36 |
| 3,928,025 | 12/1975 | Okuno et al. | 75/128 W |
| 3,929,428 | 12/1975 | Nishi et al. | 75/126 R |

FOREIGN PATENT DOCUMENTS

| | | | |
|---|---|---|---|
| 1091625 | 4/1955 | France | 148/36 |
| 55-91959 | 7/1980 | Japan | 148/36 |
| 577133 | 5/1946 | United Kingdom | 148/36 |
| 173007 | 7/1965 | U.S.S.R. | 148/36 |

OTHER PUBLICATIONS

Norstrom, L., "Performance of Hot-Work Tool Steels", *Scandanavian Journal of Metallurgy*, vol. 11, pp. 33–38, (1982).

Lyman, T., ed., et al., *Metals Handbook*, 8th Edition, vol. 7 & 8, Am. Soc. for Metals, pp. 4, 120 (vol. 7), 199 (vol. 8), TA472A3, (1973).

*Primary Examiner*—Michael L. Lewis

*Attorney, Agent, or Firm*—Fred A. Keire

[57] ABSTRACT

A hot work steel with very high resistance to tempering and a very high strength at elevated temperatures, a good ductility and a comparatively low content of expensive alloying elements; the steel contains in weight percent: 0.30–0.45 C, 0.2–1.0 Si, 0.3–2.0 Mn, 2.0–3.5 Cr, 1.5–2.5 (W/2+Mo), 0.8–1.5 V, 0–0.01 B, balance essentially only iron and impurities in normal quantities; for a further embodiment the steel contains a maximum of 1.0, preferably a maximum of 0.5 and suitably a maximum of 0.3% cobalt; in the hardened and tempered condition the steel has a fine grain lath-martensitic or partly bainitic microstructure which is free from retained austenite, and which contains a very finely dispersed intergranular precipitation of carbides, among which vanadium carbides are the dominating carbide phase.

10 Claims, 3 Drawing Figures

YIELD POINTS (YIELD STRENGTH) Rpo.2 N/mm2
1600
1400
1200
1000
800
600
400
200
500
600
700
800
TEMPERATURE °C
o STEEL NO.1
Δ STEEL NO. 2
× STEEL NO. 3
● STEEL NO. 4

HOT WORK STEEL

This is a continuation of application Ser. No. 185,942 filed Sept. 10, 1980, now abandoned.

This invention relates to a hot work steel, more particularly to a material for tools which is exposed to strong heating and wear from a metal in molten or semi-molten condition or which is heated to forging temperature. Typical fields of application for these steels are for example tools for die casting and extrusion of aluminium and copper alloys; tools for hot pressing copper alloys; and tools for steel forging. These and similar applications impose high demands upon the high-temperature strength, the resistance to tempering, and the hot ductility properties of the tool steel. These properties have a crucial impact upon the resistance of the steel against, among other things, thermal fatigue.

GENERAL BACKGROUND

In the Swedish patent specification No. 199,167, published Oct. 26, 1965, a steel alloy with high high-temperature strength is disclosed. This steel contains in percent by weight:

| | |
|---|---|
| 0.20–0.50 | C |
| 0.2–0.5 | Si |
| 2–3 | Cr |
| 2–3 | Mo, which wholly or partly may be replaced by tungsten in the ratio 1:2 |
| 0.3–0.6 | V |
| 2–3 | Co |

This known alloy, however, has an unsatisfactory resistance to tempering. The ever higher demands which are imposed by the present day technology insofar as better strength properties are concerned, also have given rise to the developement of a number of modifications and alternatives to the above alloy. By way of example, reference may be made to the steel alloys disclosed in the Swedish patent specifications Nos. 364,997, 364,998, and 364,999 (published Mar. 11, 1974), which besides iron are characterized by the following compositions (weight percent):

| | SE 364 997 | SE 364 998 | SE 364 999 |
|---|---|---|---|
| C | 0.030–0.45 | 0.35–0.45 | 0.3–0.4 |
| Si | 0.2–1.0 | 0.2–0.5 | 0.2–0.5 |
| Mn | 0.2–1.0 | 0.8–1.5 | 0.1–0.5 |
| Cr | 2.0–3.5 | 1.0–1.8 | 1.0–2.0 |
| Mo | 1.0–2.0 | 2.5–3.5 | 1.5–3.0 |
| W | 2.0–3.0 | | |
| V | 1.0–1.5 | 1.0–1.3 | 0.4–0.8 |
| Nb | 0.1–0.5 | — | — |
| B | 0.002–0.01 | 0.003–0.01 | 0.001–0.1 |
| Co | 1.5–3.0 | 1.5–2.5 | 1.5–2.5 |

As compared to the first mentioned alloy the above alloys generally exhibit improved strength properties, however, without offering a combination of features optimal for hot work steels. Moreover (and this also pertains to the first mentioned Swedish patent specification No. 199,167) the properties are obtained at the price of a comparatively high content of expensive alloying elements, among which in the first place the high cobalt contents have a dominating influence on the total costs of alloying elements.

DISCLOSURE OF THE INVENTION AND SPECIFIC EMBODIMENTS THEREOF

It is an object of the invention to eliminate the above mentioned drawbacks and/or limitations of the hot work steels which have been referred to above. More particularly it is an object of the invention to offer a hot work steel having a combination of properties which is optimal for hot work steels without being required to alloy the steel with cobalt or other very expensive alloying elements. Above all it is an object to offer a hot work steel having a very high resistance to tempering, a high high-temperature strength, and a good hot ductility, properties which are considered to have a crucial impact on the resistance of the steel against thermal fatigue.

These and other objectives can be achieved by a steel which according to the invention contains the following elements, as expressed in weight percent:

| | Widest range | Narrower range | Preferred range |
|---|---|---|---|
| C | 0.30–0.45 | 0.35–0.45 | 0.37–0.43 |
| Si | 0.2–1.0 | 0.2–1.0 | 0.2–1.0 |
| Mn | 0.3–2.0 | 0.3–1.5 | 0.3–1.0 |
| Cr | 2.0–3.5 | 2.2–3.0 | 2.4–2.8 |
| $\frac{W}{2}$ + Mo | 1.5–2.5 | *1.7–2.3 | 1.8–2.2 |
| V | 0.8–1.5 | 1.0–1.4 | 1.1–1.3 |
| B | 0–0.01 | 0–0.01 | 0–0.01 |

The balance consists essentially only of iron and impurities in normal contents. The expression "essentially only" herein shall mean that the steel, besides the elements indicated in the above table, also may contain other elements provided they do not impair those properties of the steel which are sought to be achieved. For practical as well as cost reasons, however, one should be restrictive as far as the number of alloying elements is concerned in order not to complicate the alloying considerations.

Among other things, alloys which are too complex have the drawback that the scrap from these steels represent a lower value. In the first place and for cost reasons, the steel, therefore, normally should not contain a significant content of cobalt. Hence, as a further embodiment a slight amount of cobalt is added in the above defined steels in the following amounts: up to a maximum of 1%, preferably a maximum of 0.5% and desirably a maximum of 0.3% of cobalt. Further it is also desirable that the steel does not contain other strong carbide formers beside vanadium. The total content of niobium, tantalum, titanium, and aluminium therefore should not exceed 0.5%, preferably not exceed 0.2%, and suitably not exceed 0.1%. The steel may, however, contain boron, and a preferred embodiment of the steel is characterized in that the boron content is between 0.001 and 0.005%.

The outstanding properties which have been achieved for the steel, according to the invention, are due to a favourable co-action between the different alloying elements. In the first place the comparatively high vanadium content, a content of molybdenum which is adapted to the content of vanadium, a moderate content of chromium, and a suitable content of carbon promote a good resistance to tempering as well as a high high-temperature strength.

In this disclosure, the adaption of the vanadium and molybdenum contents to each other means that the ratio of %V:%(W/2+Mo) should be 0.4–0.8, preferably 0.5–0.7. Under these conditions, the tempering carbides will display a very high stability. At the same time, the possibilities are improved for the obtaining of fine austenite grain sizes during the hardening procedure due to an increased amount of particles of the type which may reduce the grain size growth. This in turn promotes a good hot-ductility. Through the interaction of the alloying elements characterizing this invention, the steel in the hardened and tempered condition, therefore, will have a fine grain lathmartensitic or partly bainitic microstructure which is free from pearlite and essentially free from retained austenite, and which contains a very finely dispersed intergranular precipitation of carbides, among which vanadium carbides are the dominating carbide phase. "Fine grain" here means that the grain size is smaller than grain size 7 according to the ASTM-scale. The vanadium carbides in the tempered martensite have a diameter of max 0.1 μm. In the soft-annealed condition the steel has a ferritic structure containing spheroidized vanadium carbides.

After hardening from 1 050° C. for ½ hour, quenching in oil, and subsequent double annealing (1 hour+1 hour) at 700° C. and 750° C., respectively, the steel according to the invention will achieve a hardness at room temperature of approximately 375 and 300 HV 10, respectively, for the two temperatures. (HV=Vicker hardness). Yield points of approximately 175 N/mm$^2$ have been achieved.

BRIEF DESCRIPTION OF DRAWINGS

In the following report on experiments which have been carried out, reference will be made to the accompanying drawings, which in the form of graphs illustrate the achieved results, and wherein.

EXAMPLES

Figure 1:
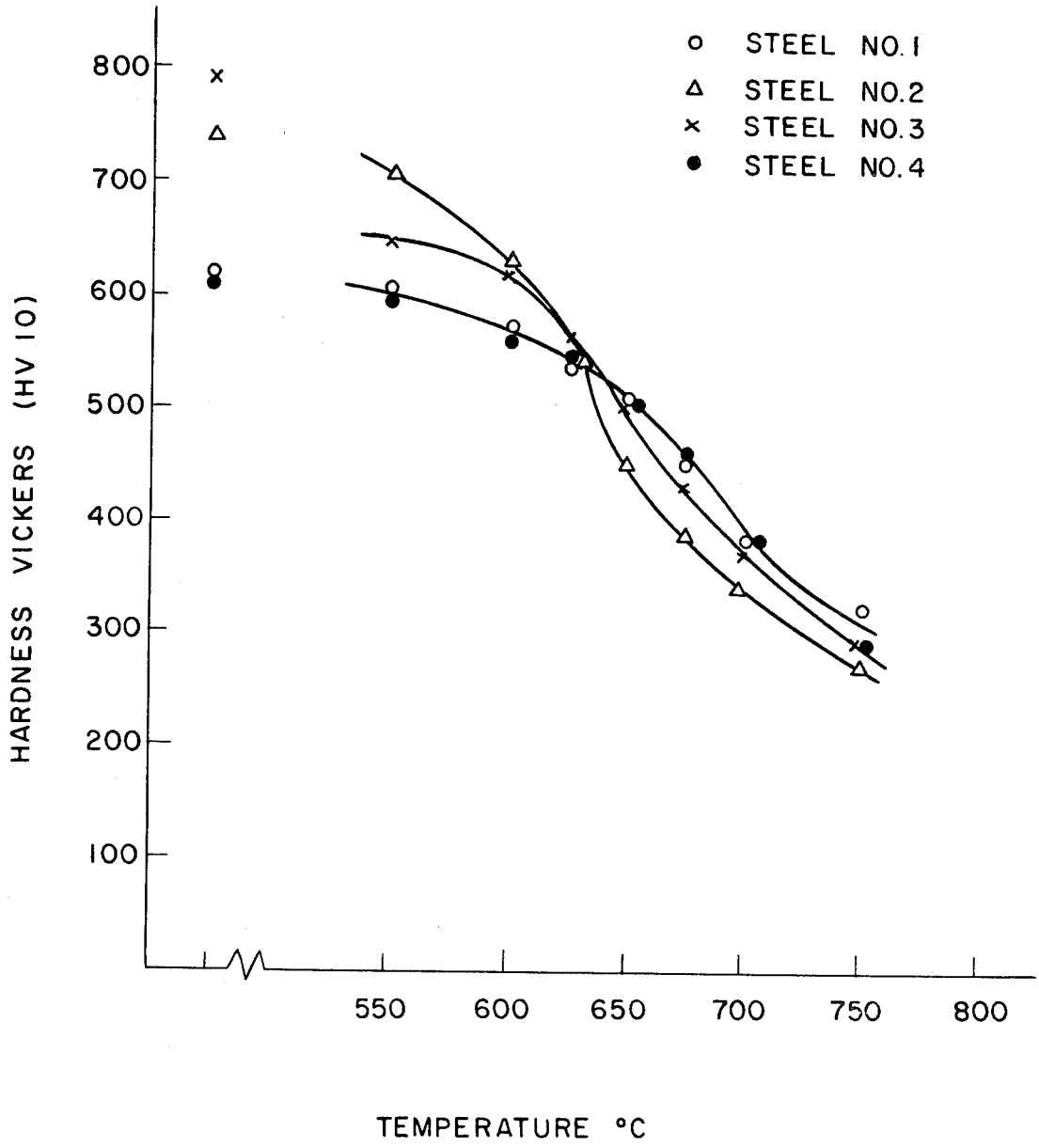
FIG. 1 is a tempering graph (1 hour+1 hour) for the investigated steels ploted as a curve for each steel of hardness against temperature.

The content of alloying elements in weight % in the following materials is shown in Table 1, balance being iron with normal impurity contents for this type of steel.

TABLE 1

| Steel No. | C | Si | Mn | P | S | Cr | Ni | Mo | V | Co | B |
|---|---|---|---|---|---|---|---|---|---|---|---|
| | Alloying composition of investigated steel and compared materials | | | | | | | | | | |
| 1** | .38 | .37 | .83 | .008 | .009 | 2.8 | .05 | 2.1 | 1.19 | 1.9 | .005 |
| 2* | .39 | .35 | .37 | .010 | .009 | 4.8 | .04 | 3.1 | .50 | | |
| 3** | .39 | .33 | 1.54 | .009 | .009 | 2.4 | .04 | 3.1 | .52 | | .005 |
| 4*** | .39 | .33 | 1.56 | .008 | .008 | 2.5 | .004 | 2.1 | 1.19 | | .005 |

*Comparative example for prior art steel
**Comparative investigation of steel used for establishing the present invention
***Present invention Steel No 1, 3 and 4 are comparative alloys, while steel No 2 is a commercial steel corresponding to German Werkstoff Nr 1.2367. Steel No. 4 has a composition according to the invention, though the content of manganese is somewhat higher than according to the preferred range.

From the investigated materials there were made flat bars, of a thickness 18 mm, by forging and rolling. The bars were then soft-annealed at 865° C./5 hours, followed by controlled cooling 7° C./hours to 600° C., and were finally air cooled to room temperature. The structure of the soft-annealed steels was all ferrite with varying amounts and types of carbides. In steel No. 4 of the invention, the dominating carbide phase was spheroidized vanadium carbides.

From the rolled bars test samples were made which were austenitized at 1 020° C./20 min. Thereafter the samples were transferred to a furnace at the temperature 800°, 750°, 700°, 650°, and 600° C. The holding times were 5, 10, 30, 60, and 120 min. After the isothermal treatment, the test samples were cooled in oil to room temperature. Except for steel No. 2 there was obtained no pearlite formation at any of the test conditions. For steel No. 2, the beginning of pearlite formation could be noticed. The lowest rate at which a steel can be cooled without the formation of pearlite taking place, is a measure on the hardenability of the steel. Thus it can be stated that the hardenability was better for steel No. 1, 3 and 4 than for steel No. 2. The hardenability substantially depends on the content of carbon and other alloying elements. The austenite grain size also has some importance. All the alloying elements which are used in the investigated materials retard the transformation to pearlite with the exception of cobalt. The grain sizes of the steels Nos. 1, 2 and 4 was approximately equal, but a heavy coarsening of the grain size had occured in steel No. 3. The continued experiments were aimed at comparing material properties which have critical impact on, among other things, the resistance to thermal fatigue. The following properties, which were determined to have an influence in this respect, therefore, have been included in the following statement of the discovered results without, however, being bound by the interpretation or the theoretical bases thereof, but relying primarily on the actual results displaying the improved properties:

Resistance to tempering
Yield point at elevated temperatures
Toughness, hot ductility

RESISTANCE TO TEMPERING

The hardness at room temperature after different tempering treatments at high temperatures is a good measure on the resistance to tempering, for comparative purposes. Soft-annealed samples therefore were hardened from austenitizing temperature 1 050° C./½ hour, quenched in oil and tempered twice (1 hour+1 hour) in the temperature range between 550° and 750° C. The results are illustrated by the curves in FIG. 1. The curves show that steels Nos. 1 and 4 have near equal hardnesses after all the temperings. Steel No. 3 has the same or somewhat lower hardnesses than steels Nos. 1 and 4 at tempering temperatures above 650° C. At lower temperatures, however, the hardness of steel No. 3 is higher. The tempering curve for steel No. 2 deviates from the curves of the other steels insofar that the hardness is higher (than the other steels) after tempering at 550°–600° C. but lower (than the hardness of the other steels) after annealing at higher temperatures. The lower hardness of steel No. 2 partly can be attributed to the higher chromium content of that steel which favours the precipitation of chromium carbides before vanadium carbide when tempering. In the untempered condition steels Nos. 1 and 4 have lower hardness than steels Nos. 2 and 3. The reason for this might be that the carbides of the latter steels are more readily dissolved at the austenization because of a lower carbide stability. Besides causing a higher hardness after hardening, this effect also causes higher hardnesses after tempering these steels at the lower temperatures of 550° and 600° C. To sum up, among the examined steels, steels Nos. 1 and 4 have the best tempering resistance at temperatures above 600°-650° C.

YIELD POINT AT ELEVATED TEMPERATURES

Tensile tests were carried out at room temperature and at 500°, 600°, 650°, 700°, and 750° C. The test samples were hardened by austenitizing at 1 050° C./½ hour; quenched in oil and tempered to hardness 47 HRC. The result from the tensile tests are shown by the curves of FIG. 2.

Figure 2:
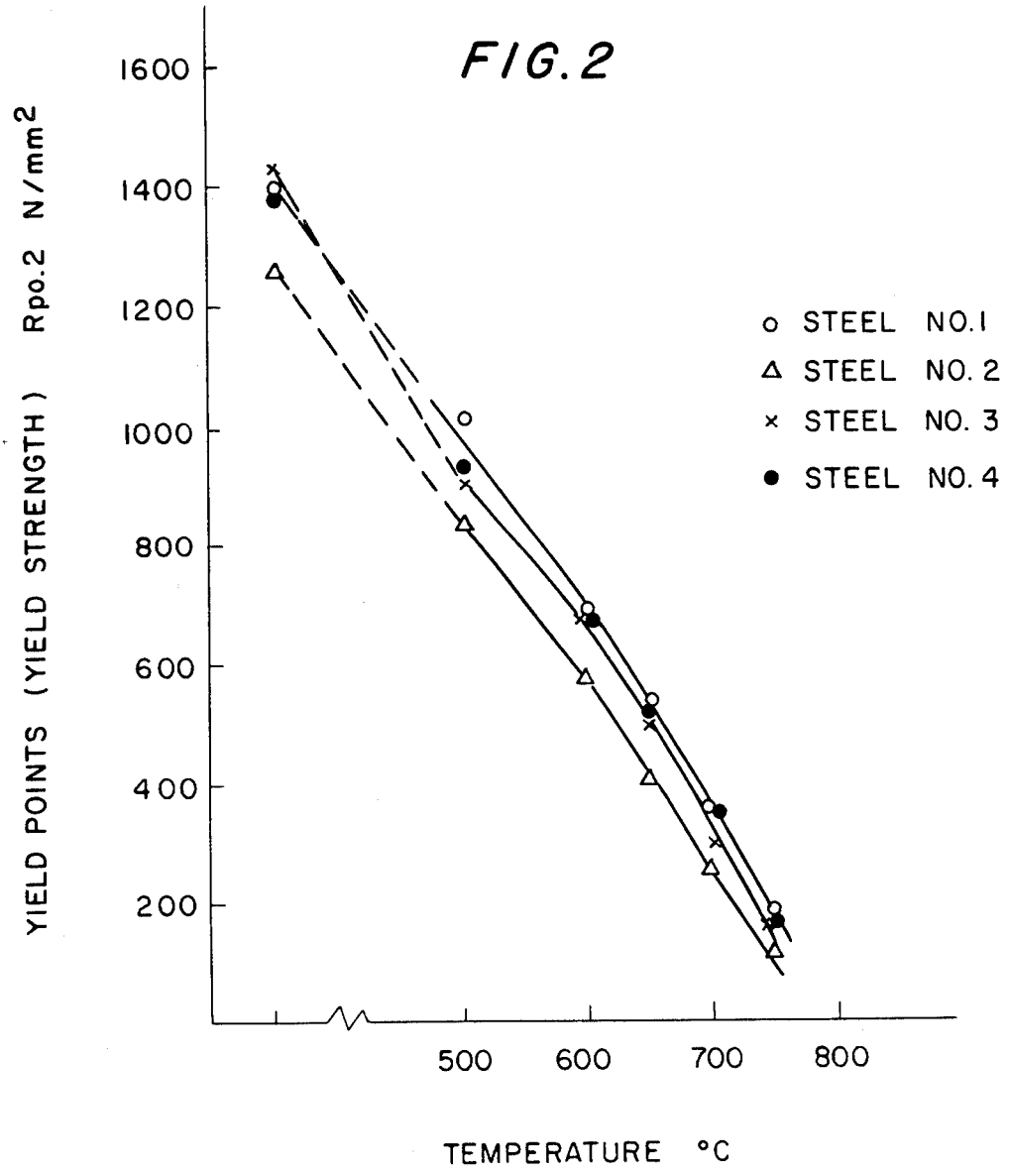
FIG. 2 is a graph for the same steels as in FIG. 1 showing measured yield points (yield strength) at different temperatures with initial hardness being 47 HRC (HRC=Rockwell hardness C)

As is apparent from the curves of FIG. 2, steels Nos. 1 and 4 have almost equal room temperature and elevated temperature yield points. Steel No. 3 and particularly steel No. 2 have clearly lower values at all test points. The reason for the higher yield point at elevated temperatures of steels Nos. 1 and 4 is supposed to be due to the fact that these alloy compositions promote the precipitation of finely dispersed vanadium carbides at the tempering operation. This is favourable for a good resistance to tempering as well as for a high yield point at elevated temperatures, because the finely dispersed vanadium carbides bring about an effective and temperature stable dispersion-hardening. The conclusion therefore is that the best strengths at elevated temperatures are achieved by steels Nos. 1 and 4, but it is remarkable that equally high yield point values at elevated temperatures have been reached for steel No. 4 according to the invention and for steel No. 1, although the latter steel has a higher content of cobalt which is an expensive alloying element known for its contribution to high temperature properties.

TOUGHNESS; HOT-DUCTILITY

Figure 3:
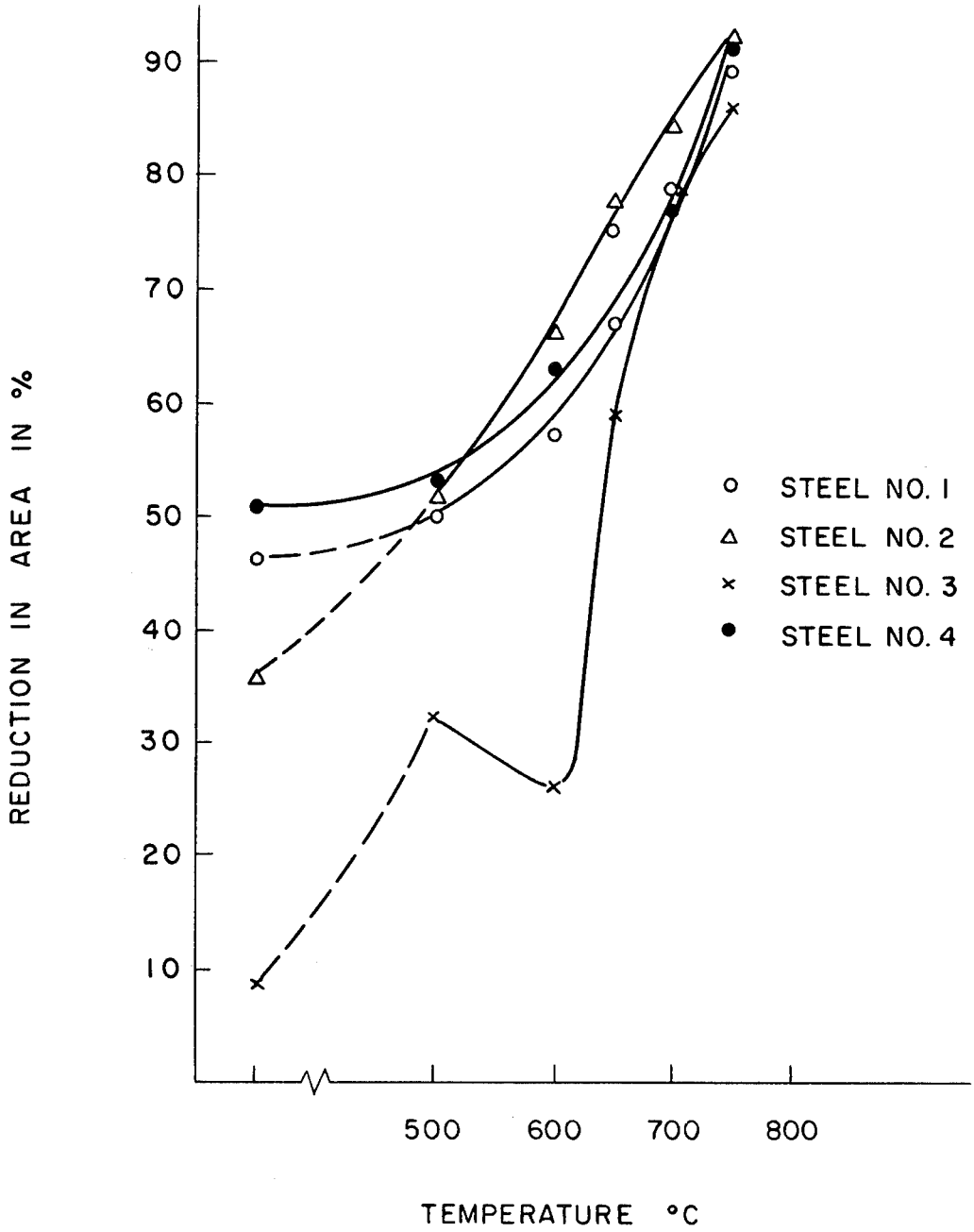
FIG. 3 is an illustration of the reduction in area for the steels as in FIG. 1 at different temperatures with initial hardness being 47 HRC.

The reduction of the area of fracture at hot tensile testing is a usual measure of the toughness or hot-ductility of a steel. In FIG. 3 the reduction of the area of fracture during hot tensile testing for the four steels have been shown in the form of curves. From these curves it is possible to draw the conclusion that the reduction of area of steel No. 3 is remarkably different from those of the other steels as it has very low values at room temperature and at 500° and 600° C. Steel No. 4, which is a steel according to the invention, has the best values up to about 600° C. At higher temperatures the curves converge such that these differ only very slightly from each other. The inferior hot-ductility of steel No. 3 is due probably mainly to a coarser grain size of this steel, which in turn is due probably to a low chromium and a low vanadium content of the steel. As a result, most of the carbides are dissolved at the austenitization so that no carbide particles remain to work as grain growth inhibitors. Structure examinations show that a fine austenite grain size is desirable from ductility point of view and that the content of vanadium and a content of molybdenum adapted to the vanadium content have an important effect on the grain growth. "Partly bainitic" in this specification is meant to be a bainitic microstructure which normally is less than 25%, and in extreme cases up to about 50%, of a microstructure observed in a given field, the balance being a "lath-martensitic structure". The vanadium carbide and the diameter thereof is measured as maximum diameter by transmission electron microscopy. The term "$R_{p0.2}$" as used in this specification is the internationally standardized symbol for the 0.2% offset stress, corresponding to the previously used symbol $\sigma_{0.2}$.

What is claimed is:

1. A hot work tool steel with a very high resistance to tempering and very high strength at elevated temperatures, a good ductility and a comparatively low content of expensive alloying elements, consisting essentially, in percent by weight, of: 0.35–0.45 C, 0.2–1.0 Si, 0.3–1.5 Mn, 2.2–3.5 Cr, 1.7–2.3 (W/2+Mo), 1.0–1.4 V, 0.001–0.01 B, and cobalt up to 0.5%, maximum, by weight where vanadium carbides are a dominating phase, balance iron and normal contents of impurities and wherein the ratio of %V/(%W/2+%Mo) is between 0.4 and 0.8.

2. The steel as defined in claim 1, wherein the same consists essentially, in percent by weight, of: 0.35–0.45 C, 0.2–1.0 Si, 0.3–1.5 Mn, 2.2–3.0 Cr, 1.7–2.3 (W/2+Mo), 1.0–1.4 V, 0.001–0.01 B, cobalt up to 0.5%, maximum, by weight, balance iron and normal contents of impurities, and wherein the ratio of V/(W/2+Mo), in percent by weight, is 0.4–0.8.

3. The steel as defined in claim 2, wherein the same consists, in percent by weight, of: 0.37–0.43 C, 0.2–1.0 Si, 0.3–1.5 Mn, 2.4–2.8 Cr, 1.8–2.2 (W/2+Mo), 1.1–1.3 V, 0.001–0.01 B, and cobalt up to 0.5%, maximum, by weight, balance iron and normal contents of impurities.

4. The steel as defined in claim 1 wherein the same has, in addition, a maximum of 0.3%, by weight, of cobalt.

5. The steel as defined in claim 1 wherein the same contains a total amount of niobium, tantalum, titanium, and aluminum of a maximum of 0.5%.

6. The steel as defined in claim 1 wherein the said steel contains 0.001–0.005% B.

7. The steel according to claim 1, wherein the ratio of %V/(%W/2+Mo) is between 0.5 and 0.7.

8. The steel as defined in claim 1, wherein the steel has in a hardened and tempered condition a fine grain lath-martensitic or a partly bainitic microstructure which is free from pearlite and essentially free from retained austenite, and which contains a very finely dispersed intergranular precipitation of carbides, among which vanadium carbides are the dominating carbide phase.

9. The steel as defined in claim 8, wherein the grain size is smaller than ASTM grain scale size 7, and the vanadium carbides essentially have a cross-sectioned average diameter not exceeding 0.1 μm.

10. The steel as defined in claim 1, wherein the steel has in a soft-annealed condition, a ferritic structure containing spheroidized vanadium carbides as the dominating carbide phase.

* * * * *